US005520473A

United States Patent [19]

Durham

[11] Patent Number: 5,520,473

[45] Date of Patent: May 28, 1996

[54] BALL POINT PEN

[75] Inventor: Lawrence H. Durham, Los Angeles, Calif.

[73] Assignee: The Gillette Company, Boston, Mass.

[21] Appl. No.: 495,709

[22] Filed: Jun. 27, 1995

Related U.S. Application Data

[63] Continuation of Ser. No. 904,947, Jun. 26, 1992, abandoned.

[51] Int. Cl.[6] ..... B43K 7/00; B43K 7/10

[52] U.S. Cl. ..... 401/216; 29/441.2

[58] Field of Search ..... 401/216; 29/441.2

[56] References Cited

U.S. PATENT DOCUMENTS

| | | | |
|---|---|---|---|
| 2,592,406 | 4/1952 | Faltin | 401/216 |
| 2,813,512 | 11/1957 | Schrader | 120/42.4 |
| 2,813,513 | 11/1957 | Seyer | 120/42.4 |
| 2,818,828 | 1/1958 | Schachter | 113/32 |
| 2,967,353 | 1/1961 | Arengo | 401/216 X |
| 3,000,353 | 9/1961 | Schwarzaugl | 401/216 |
| 3,030,926 | 4/1962 | Sattmann . | |
| 3,315,347 | 4/1967 | Schachter | 401/216 X |
| 3,319,331 | 5/1967 | Fehling et al. | 401/216 X |
| 3,496,627 | 2/1970 | Mazzier et al. | 401/216 X |
| 3,966,336 | 6/1976 | Lotfallah | 401/209 |
| 4,116,569 | 9/1978 | Reed et al. | 401/216 |
| 4,139,313 | 2/1979 | Hori | 401/216 |
| 4,145,148 | 3/1979 | Fukuoka | 401/209 |
| 4,221,490 | 9/1980 | Malm | 401/29 |
| 4,231,146 | 11/1980 | Nakagawa et al. | 29/432 |
| 4,251,164 | 2/1981 | Nakagawa et al. | 401/216 |
| 4,311,403 | 1/1982 | Liguori | 401/209 |
| 4,355,915 | 10/1982 | Kaji et al. | 401/216 |
| 4,384,800 | 5/1983 | Dyama | 401/216 |
| 4,529,329 | 6/1985 | Hirabayashi et al. | 401/209 |
| 4,717,277 | 1/1988 | Hutt | 401/216 |
| 4,722,124 | 2/1988 | Serikawa et al. | 29/441 |
| 4,952,089 | 8/1990 | Schneider | 401/216 |
| 5,000,605 | 3/1991 | Schneider | 401/209 |
| 5,012,663 | 5/1991 | Brown | 72/369 |
| 5,056,949 | 10/1991 | Petrillo | 401/214 |
| 5,104,249 | 4/1992 | Elsner et al. | 401/216 |

FOREIGN PATENT DOCUMENTS

| | | | |
|---|---|---|---|
| 734725 | 5/1966 | Canada | 401/216 |
| 1088463 | 10/1980 | Canada . | |
| 965583 | 9/1950 | France | 401/216 |
| 66051 | 5/1956 | France | 401/216 |
| 1568912 | 5/1969 | France | 401/216 |
| 2412471 | 7/1979 | France . | |
| 804295 | 2/1951 | Germany | 401/216 |
| 940872 | 3/1956 | Germany | 401/216 |
| 1905139 | 10/1969 | Germany | 401/216 |
| 2743888 | 9/1977 | Germany . | |
| 2921286 | 12/1979 | Germany . | |
| 3301571 | 7/1984 | Germany . | |
| 131678 | 7/1984 | Japan | 401/216 |
| 261698 | 10/1990 | Japan | 401/216 |
| 365634 | 12/1962 | Switzerland | 401/216 |
| 660784 | 11/1951 | United Kingdom . | |
| 713169 | 8/1954 | United Kingdom . | |
| 2067475 | 7/1981 | United Kingdom . | |
| 2065565 | 7/1981 | United Kingdom . | |

*Primary Examiner*—Steven A. Bratlie

*Attorney, Agent, or Firm*—Owen J. Meegan; Aubrey C. Brine; Donal B. Tobin

[57] ABSTRACT

A ball point pen includes a tubular member with a hollow interior placeable in fluid communication with an ink supply, a socket formed at one end of the member having a seat and a cylindrical wall extending from the seat and a rim structure disposed at the end of the cylindrical wall opposite the seat, a spherical ball disposed in the socket, rotatably engagable with the seat and captured by the rim structure, the diameter of the ball being at least three percent smaller than the diameter of the seat at the intersection of the seat and the cylindrical wall.

6 Claims, 6 Drawing Sheets

BALL POINT PEN

This is a continuation of applications(s) Ser. No. 07/904,947 filed on Jun. 26, 1992 now abandoned.

BACKGROUND OF THE INVENTION

This invention relates to ball point pens.

Various types of ball point pens are in widespread use, for example, those in which the entire pen is disposable after the ink supply has been used, and "retractable" ball point pens in which a ball point refill is spring-loaded within a permanent outer body. The term "ball point pen", as used herein, refers to both disposable pens and ball point refills.

Ball point pens generally include a tubular member in communication with an ink supply, a socket formed at the tip of the tubular member which receives a spherical ball and terminates in deformable rim structure dimensioned to retain the ball, ball seat structure at the base of the socket against which the ball is seated, and an ink feed system extending from the ball seat to the ink supply for supplying ink to the surface of the ball. The ink feed system is typically arranged so as to provide a uniform flow of ink to the ball, e.g., in a star shaped arrangement of capillary channels which radiate out from a central aperture in communication with the ink supply. In some cases, wear of the ball seat during extended use of the pen may cause the channels of the aperture to become blocked by the ball The ink flow, or "ink laydown" i.e., amount of ink which is deposited for a line of a given length, from the ball point has traditionally been controlled by precisely controlling the socket diameter. The socket is initially bored to a diameter which has approximately the same diameter as the ball (typically up to one percent larger for a brass socket, and up to one percent smaller for a stainless steel socket), capillary flow passages are formed in the base of the socket by a metal punch operation, the ball is inserted into the socket and hammered to form a conforming ball seat at the base of the socket, and then the ball is freed by spinning the outer surface of the rim structure to stretch and deform the wall of the socket slightly away from the ball. If the desired ink laydown is not obtained using a given initial socket diameter, different initial socket diameters are tried until a desired laydown is obtained. To vary the diameter of the socket, it is necessary to adjust the boring tool, and carefully measure the resulting diameter using specialized equipment, a labor-intensive procedure requiring a highly skilled worker. Each time a new lot of point metal is used in the manufacturing process, this labor-intensive set-up procedure must be repeated.

SUMMARY OF THE INVENTION

In accordance with one aspect of the invention, the ink laydown of a ball point pen can be easily varied over a wide range, by varying the thickness of the socket rim structure without changing the socket diameter. The thickness of the initial rim structure (rim structure prior to spinning) can be precisely adjusted by the use of conventional, easily adjusted facing machinery, thus eliminating the labor-intensive set up process previously required when changing inks or varying other process parameters. Unexpectedly, it has been found that at initial socket diameters which are greater than the diameter of the ball by at least about three percent, the ink laydown is no longer a significant function of or controlled by minor variations (less than about one percent) in the socket diameter. Accordingly, the socket diameter need not be closely and laboriously controlled. Further, the larger socket diameter allows the capillary channels of the ink feed system to extend further than the diameter of the ball, reducing blockage problems due to ball seat wear by providing a channel area which cannot be blocked by the ball as the ball wears into the seat over the life of the pen.

In one aspect, the invention features a ball point pen including a tubular member for fluid communication with an ink supply, socket structure at one end of the member that has seat structure, an interior wall surface extending from the seat and rim structure disposed at the end of the interior wall surface opposite the seat structure, and a spherical ball that is disposed in the socket structure, rotatably engagable with the seat structure and captured by the rim structure. The diameter of the ball is at least three percent smaller than the diameter of the seat structure at the intersection of the seat structure and the interior wall surface.

In preferred embodiments, the seat structure includes a central aperture, an array of delivery channels extending radially from the central aperture for delivering ink to the surface of the ball, and lands disposed between the delivery channels contactable with the surface of the ball; the diameter of the ball is at least about 0.03 millimeter smaller than the diameter of the seat structure, more preferably about 0.05 to 0.08 millimeter smaller than the diameter of the seat structure; and delivery channels preferably extend to the cylindrical portion of the wall surface of the socket structure. In particular embodiments, the diameter of the ball is at least about three percent, more preferably about five percent, smaller than the diameter of the seat structure and the thickness of the initial rim structure (before spinning) is from about three percent to about eight percent of the outer diameter of the ball; and in a particular embodiment, the ball has a diameter of one millimeter and the seat structure has a diameter of about 1.06 millimeters.

In accordance with another aspect of the invention, there is provided a method of varying the amount of ink flow from a ball point pen including the steps of (a) providing a first tubular member with a hollow interior placeable in fluid communication with an ink supply, socket structure at one end of the member having seat structure, an interior wall surface extending from the seat structure and rim structure disposed at the end of the interior wall surface opposite the seat structure, the rim structure having a first thickness, (b) inserting a ball into the socket structure, (c) reducing the circumferential dimension of the rim structure to retain the ball in the socket structure, (d) measuring a first ink laydown, e.g., by moving the pen across a substrate; and (e) providing a second tubular member like the first tubular member but having a rim structure of second thickness, different from the thickness of the first member, to obtain a second ink laydown, different from the first ink laydown.

In preferred embodiments, the rim thickness is varied by facing the rim structure to obtain a rim of different thickness. Preferably, the method includes the steps of: a) providing a first tubular member with a hollow interior placeable in fluid communication with an ink supply, socket structure at one end of the member having seat structure, a cylindrical wall surface extending from the seat and rim structure disposed at the end of the cylindrical wall surface opposite the seat structure, the rim structure having a first thickness, (b) inserting a ball into the socket structure, (c) reducing the circumferential dimensions of the rim structure to retain the ball in the socket structure, (d) measuring a first ink laydown, (e) providing a second tubular member with a hollow interior placeable in fluid communication with an ink supply, socket structure at one end of the second member having seat structure, a cylindrical wall surface extending from the seat structure and rim structure disposed at the end of the cylindrical wall surface opposite the seat structure, the rim structure having a first thickness, (f) facing the rim structure to remove a portion of the socket wall of the second tubular member to obtain rim structure having a second thickness different from the rim thickness of the first tubular member, (g) inserting a ball into the socket structure of said second tubular member, (h) reducing the circumferential dimensions of the rim structure to retain said ball in the socket structure, and (i) measuring a second ink laydown, different from the first ink laydown. Preferably, the second thickness of the rim structure is from about 0.03 to 0.08 millimeter, the diameter of the ball is at least about 0.03 millimeter smaller than the diameter of the seat structure, more preferably about 0.05 to 0.08 millimeter smaller than the diameter of the seat structure; and delivery channels preferably extend to the cylindrical interior wall surface of the socket structure.

Other features and advantages of the invention will be seen from the Description of Particular Embodiments and from the claims.

DESCRIPTION OF PARTICULAR EMBODIMENTS

Figure 1:
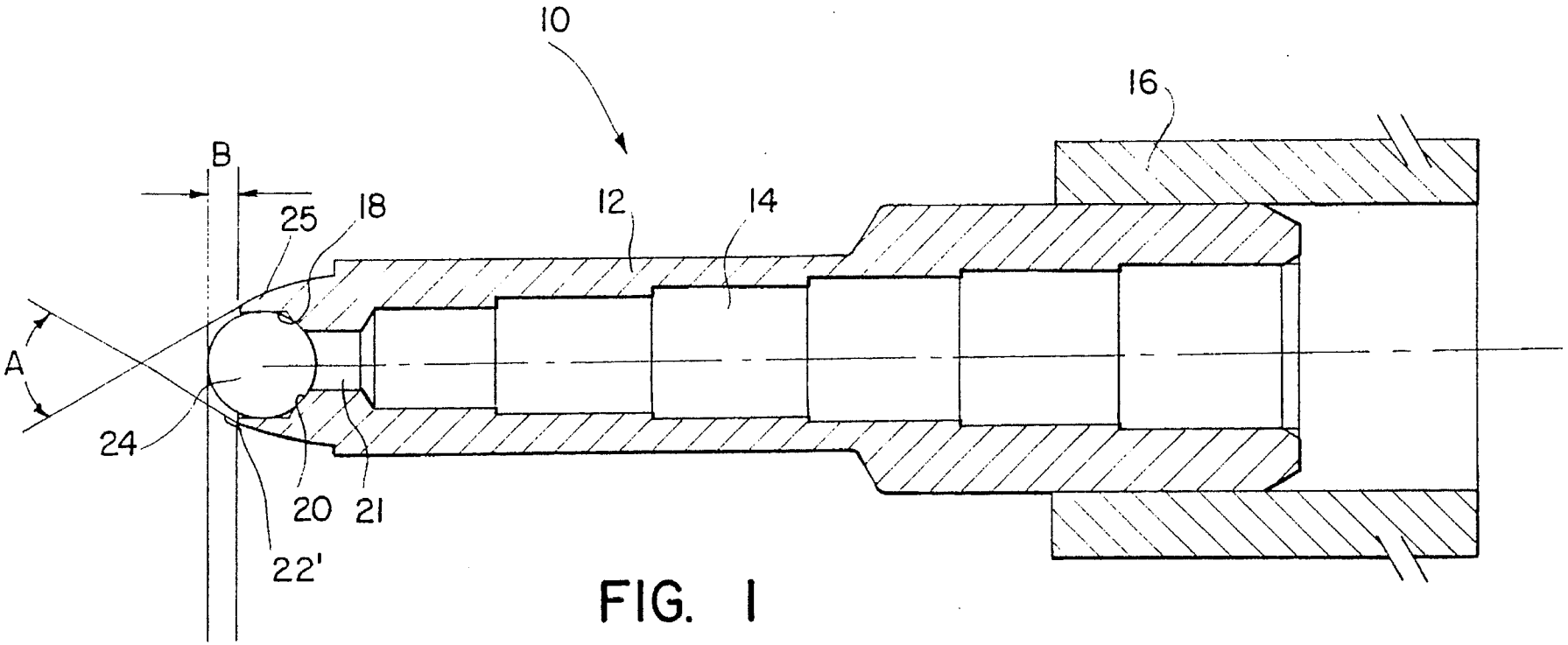
FIG. 1 shows a cross-sectional view of a ball point pen tip according to one embodiment of the invention.

Referring to FIG. 1, a ball point pen tip 10 includes tubular member 12 defining hollow interior 14. Interior 14 is in fluid communication with ink supply 16, and delivers an ink by capillary action through central passage 21 to the surface of spherical ball 24. Ball 24 is disposed in socket 18 which has a cylindrical wall 11 (FIG. 3), seat structure 20, on which ball 24 is seated, and rim structure 22 at the end of cylindrical wall 11 opposite seat 20. As shown in detail in FIGS. 4 and 8, seat structure 20 is in communication with central aperture 21 and has a plurality of radially extending channels 26 for delivering ink from central aperture 21 to the surface of ball 24, and lands 28 between channels 26, for supporting ball 24 in seat 20 when the ball rests against lands 28. Ball 24 is rotatably engagable with lands 28 and with cylindrical wall 11 as the ball rotates during writing. As shown in FIG. 4, in a preferred embodiment, channels 26 extend from aperture 21 out to approximately the intersection of the wall of socket 18 and seat 20, e.g., within 0.01 millimeter of the intersection. Channels 26 are typically formed by impressing with a punch member and have a width of from about 0.05 to 0.2 millimeter, preferably about 0.10 millimeter, and a depth of from about 0.09 to 0.25 millimeter, preferably about 0.125 millimeter. In a preferred embodiment, ball 24 is textured carbide and tubular member 12, including the socket area, is stainless steel. Other materials, e.g., a brass tubular member, may also be used to achieve objectives of the present invention.

Figure 8:
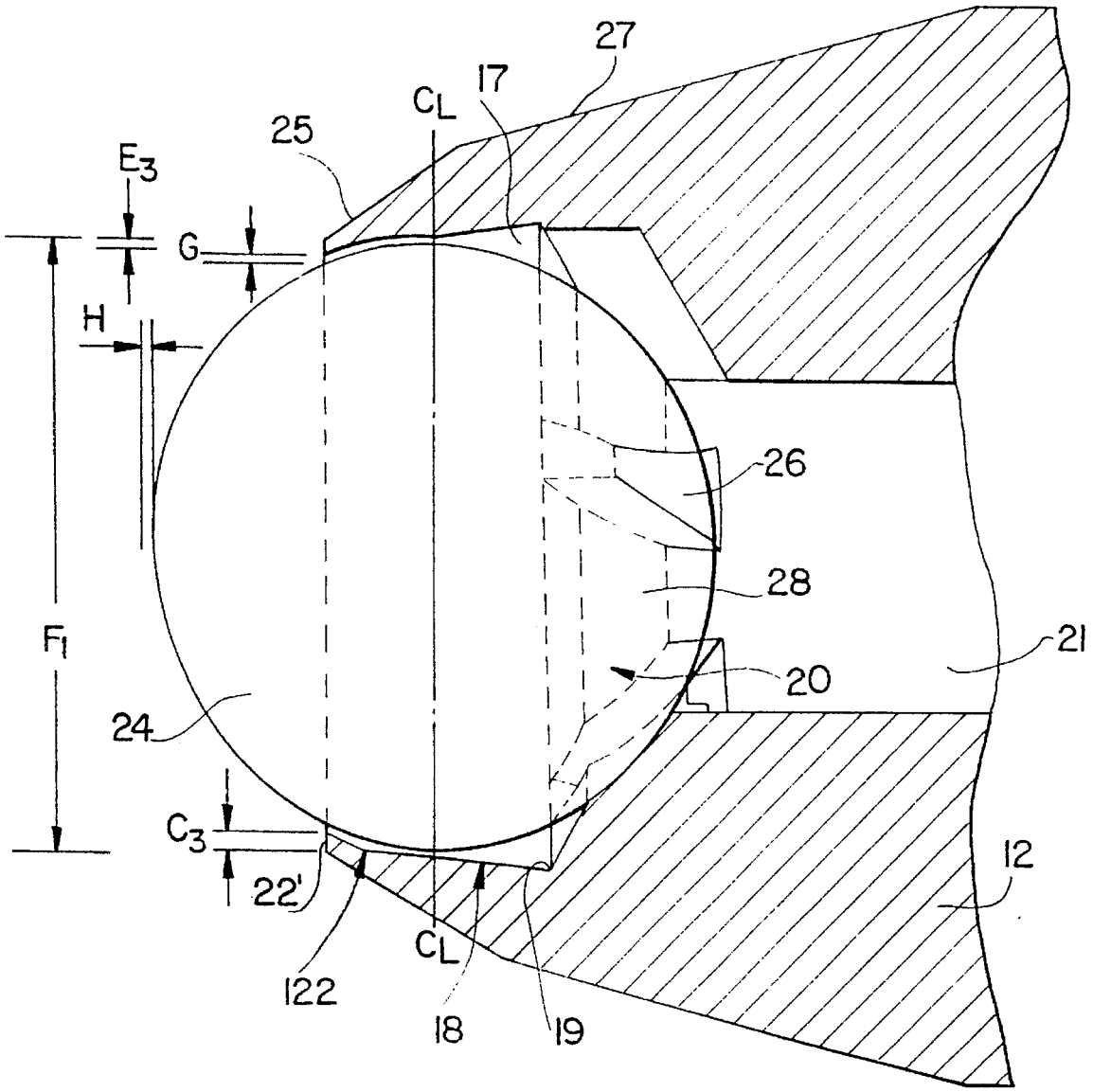
FIG. 8 shows a highly enlarged cross-sectional view of a portion of the pen tip of FIG. 1.

FIGS. 1 and 8 show pen tip 10 after it has been spun, forming spin band area 25 in outer cone surface 27. The included angle of the spin band area (angle A) is preferably from about 55 to 65 degrees, more preferably about sixty degrees. The inner surface 11 of the socket, in the deformable area 122 (FIG. 8) adjacent spin band area 25, is curved to a contour similar to the ball. The formation of the inwardly deformed rim structure adjacent the spin band area causes the opening defined through the inner peripheral edge of finished rim structure 22' to have a smaller diameter than the outer diameter of ball 24, retaining the ball within the socket.

When ball 24 is seated on seat 20, it protrudes from the socket beyond finished rim structure 22' an amount indicated by dimension B in FIG. 1, and referred to as the "ball protrusion". The ball protrusion in a preferred embodiment is from about 0.25 to 0.35 millimeter, more preferably about 0.29 millimeter, for a ball diameter of about one millimeter. If the ball protrusion is too low, the rim may drag along the writing surface when the pen is in use, while if the protrusion is too high the ball may pop out of the socket.

The amount by which the inner diameter of the socket at the inwardly-deformed rim surface differs from the diameter of ball 24 will determine how much the ball will be able to protrude from the socket when the ball is not seated on seat 20, but is instead pushed forward against the inwardly-deformed rim structure. The axial movement of ball 24 between this position and its seated position, referred to as "ball play" (dimension H in FIG. 8), affects the ability of excess ink to flow back into the pen during writing, providing a smoother line.

Figure 2:
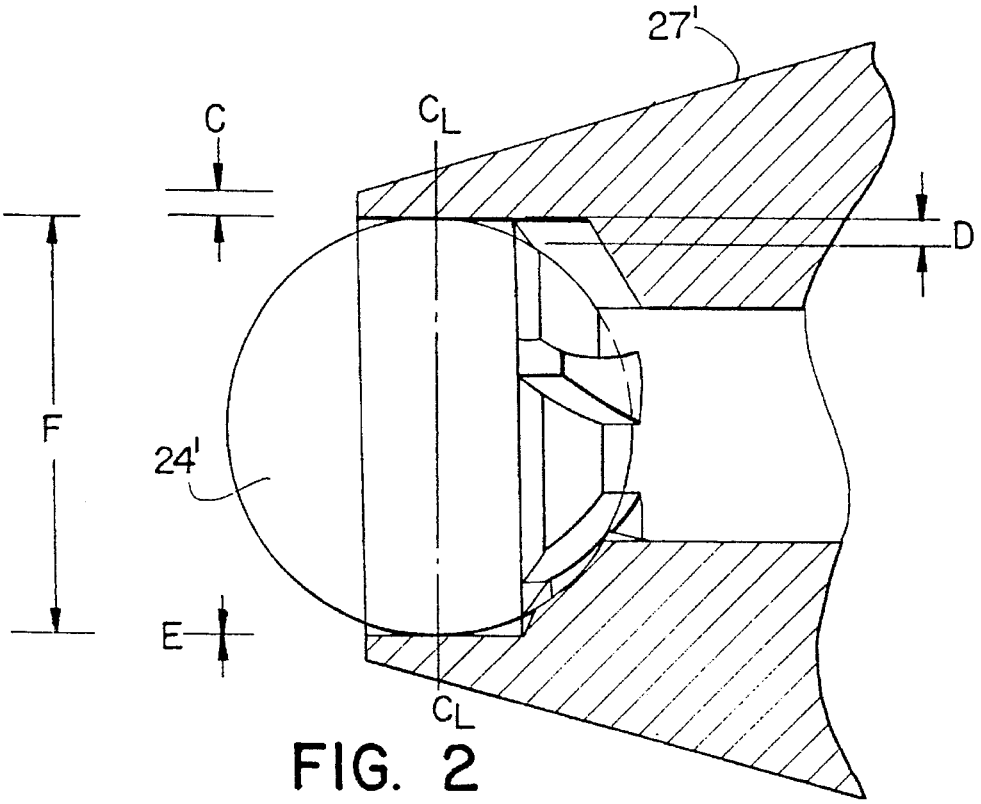
FIGS. 2 and 3 show detailed cross-sectional views of a prior art pen tip and the pen tip of FIG. 1, respectively, prior to spinning.
Figure 3:
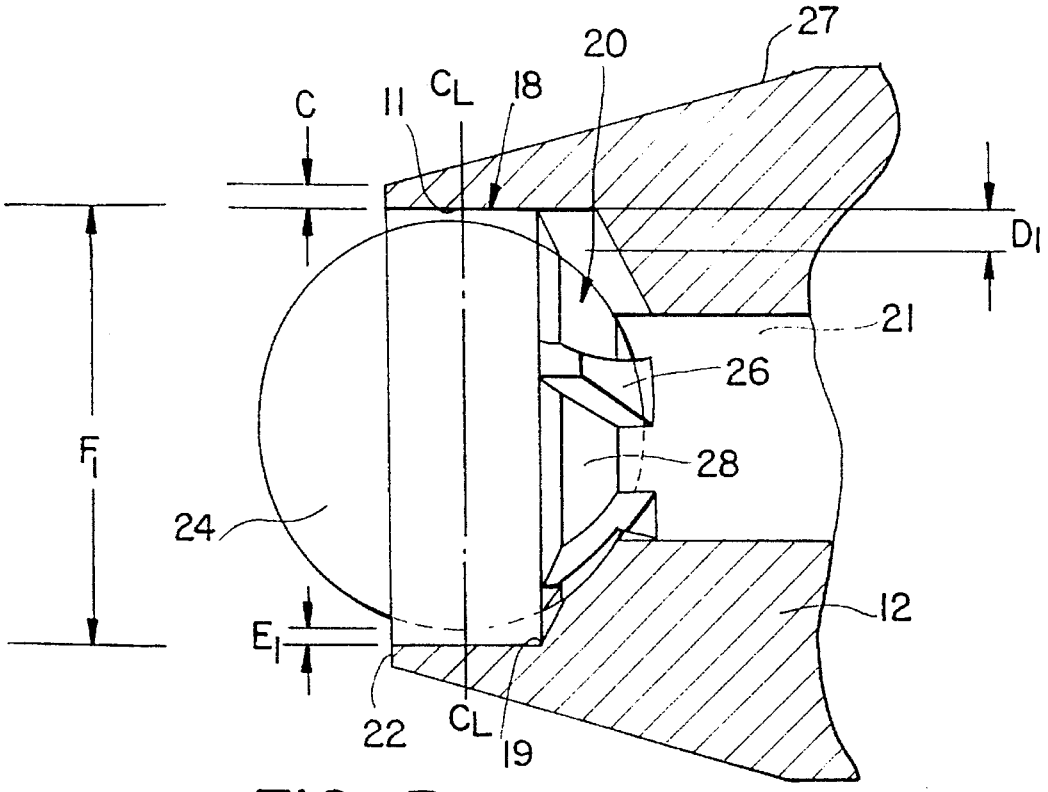
Figure 4:
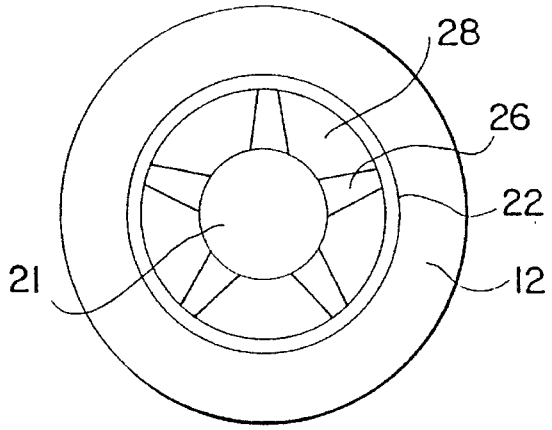
FIG. 4 shows an end view of the pen tip of FIG. 1, with the ball omitted, enlarged to show detail of delivery channels in the socket seat.

Referring to FIGS. 2 and 3, pen tips of the prior art and according to one embodiment of the invention, respectively, are shown before the spinning procedure. Prior to spinning, the outer cone surface 27 is tapered at a 25 to 40 degree angle, with thirty degrees being preferred in the instant invention, and the initial rim structure 22 has initial rim thickness C.

In a prior art pen tip, shown in FIG. 2, ball 24' has been forced into the socket, which, prior to insertion of the ball, had an initial inner diameter (F) smaller than that of the ball, typically by about one percent for a stainless steel socket. The ball typically cannot, at this point in the manufacturing process, be moved or rotated in the socket, and is freed by the spinning procedure discussed above, which forms spin band area 25 (FIGS. 1 and 8) and simultaneously increases the diameter of the socket at the equator (CL) of the ball. The portion of channel 26, which extends beyond the surface where the ball contacts seat 20 (D) is small. The small inner diameter of the socket also causes the gap between the equator of the ball and the socket wall (E) to be negligible.

In contrast, in the pen tip shown in FIG. 3, socket 18 has an initial diameter ($F_1$, see also FIG. 6) greater than that of ball 24 by at least three percent. For example, for a conventional ball having a diameter of 1.00 millimeter, $F_1$ is at least 1.03 millimeter, preferably about 1.06 millimeter. The initial socket diameter can be somewhat larger, e.g., up to about ten percent of the ball diameter, if so desired.

The relatively large initial diameter of the socket substantially increases the portions of channels 26 which extend beyond the surface of ball 24 in contact with the seat ($D_1$), preventing channel blockage when ball 24 wears into the seat and wears down lands 28 during extended use and providing a larger area in the finished pen (see region 17, FIG. 8), thus increasing the area to which excess ink can be returned during writing and improving ink coverage of the surface of ball 24.

Although ink laydown is effectively determined by the ball gap (dimension G in FIG. 8), there is a direct correlation between this dimension and the initial rim thickness. It has been found that the thinner the initial rim thickness, the greater the resulting ball gap and the greater the ink laydown. Initial rim thicknesses and laydown rates, using standard 1.00 millimeter carbide balls and stainless steel (SF20T) tubular tip members, with other process parameters maintained substantially constant, are shown in Table 1 below.

TABLE 1

| Initial Rim Thickness (millimeters) | Laydown Rate (mg/185 ft.) |
|---|---|
| 0.062 | 12 |
| 0.053 | 14 |
| 0.046 | 17 |
| 0.036 | 22 |

Preferred ink laydown rates are from about 12 to 18 mg/185 ft., for the embodiment disclosed. It should be well understood that other ink laydown rates may be obtained for other ball/rim structure combinations, by the practice of the present invention.

The initial thickness of initial rim structure 22 can either be reduced or increased by facing the initial rim structure 22 to a lesser or greater degree before the ball is inserted in the socket. The initial rim structure 22 can be faced a predetermined amount (determined by trying different initial rim thicknesses to establish what thickness provides the desired ink laydown) to obtain a suitable initial rim thickness.

Figure 5:
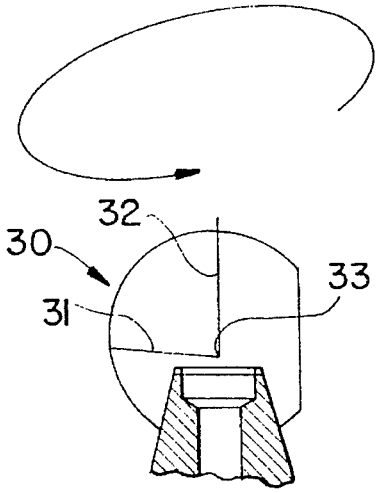
FIGS. 5 and 5*a* show schematic views of a facing tool being used to face a pen tip according to one embodiment of the invention.
Figure 6:
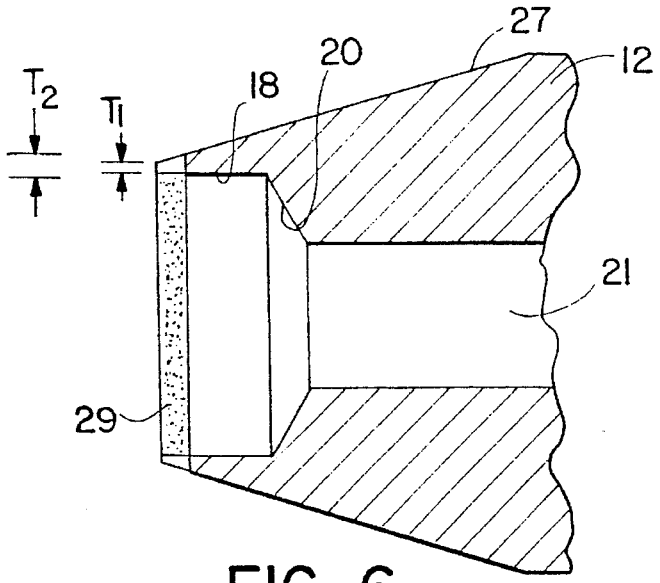
FIG. 6 shows a cross-sectional view of the pen tip of FIG. 5 before and after facing.
Figure 5A:
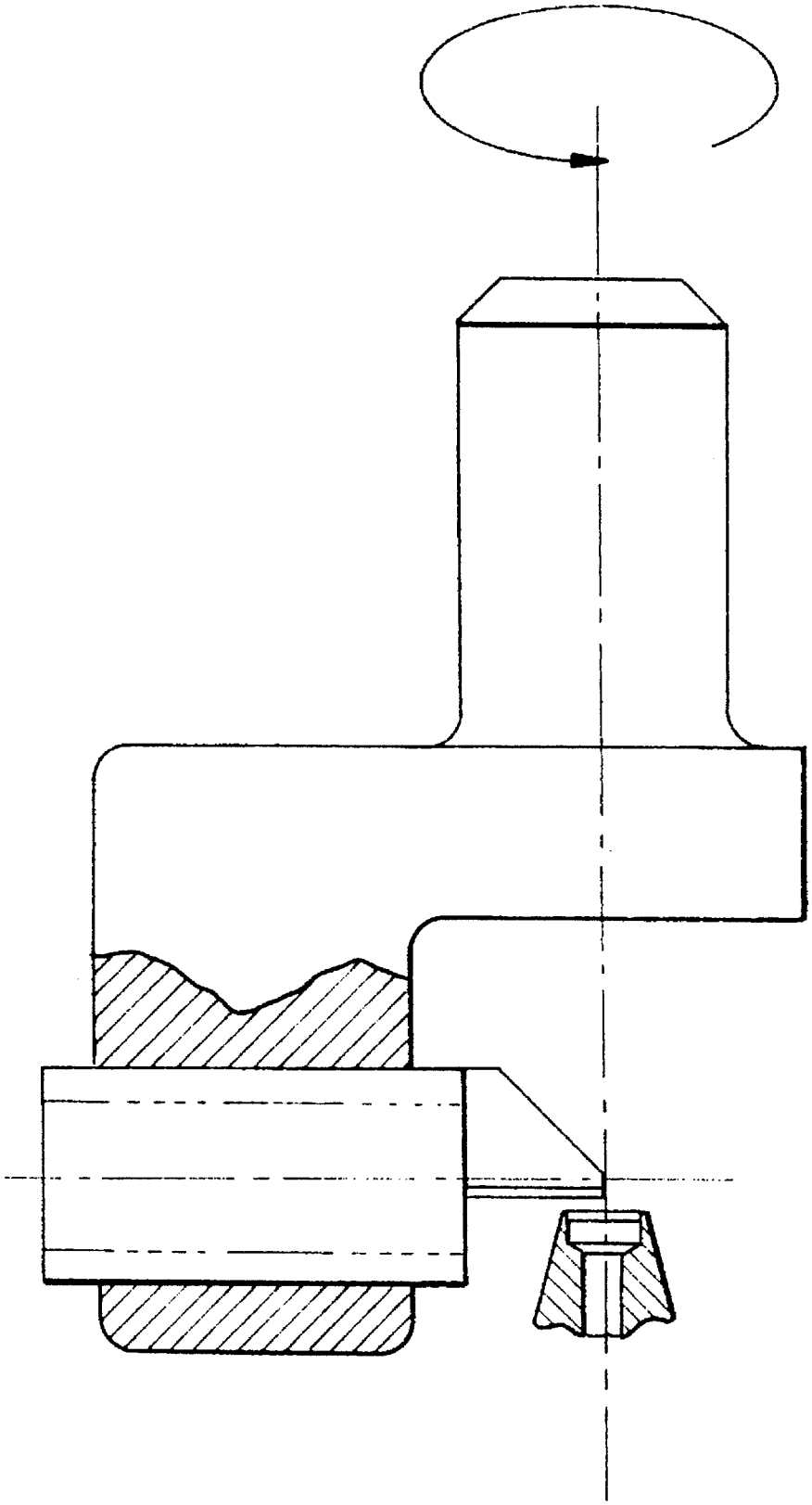

A conventional facing tool 30 is shown in FIGS. 5 and 5*a*, with arrow 31 indicating the rotation of the cutting edge 33 as the tool 30 moves downward to remove material from the surface of the initial rim structure. FIG. 6 shows material 29 which may be removed by facing, causing the initial thickness of rim structure 22 to increase from $T_1$ to $T_2$. Facing is typically performed at about 14,000 to 17,000 rpm for stainless steel tubular members, and up to about 22,000 rpm for brass tubular members.

Figure 7:
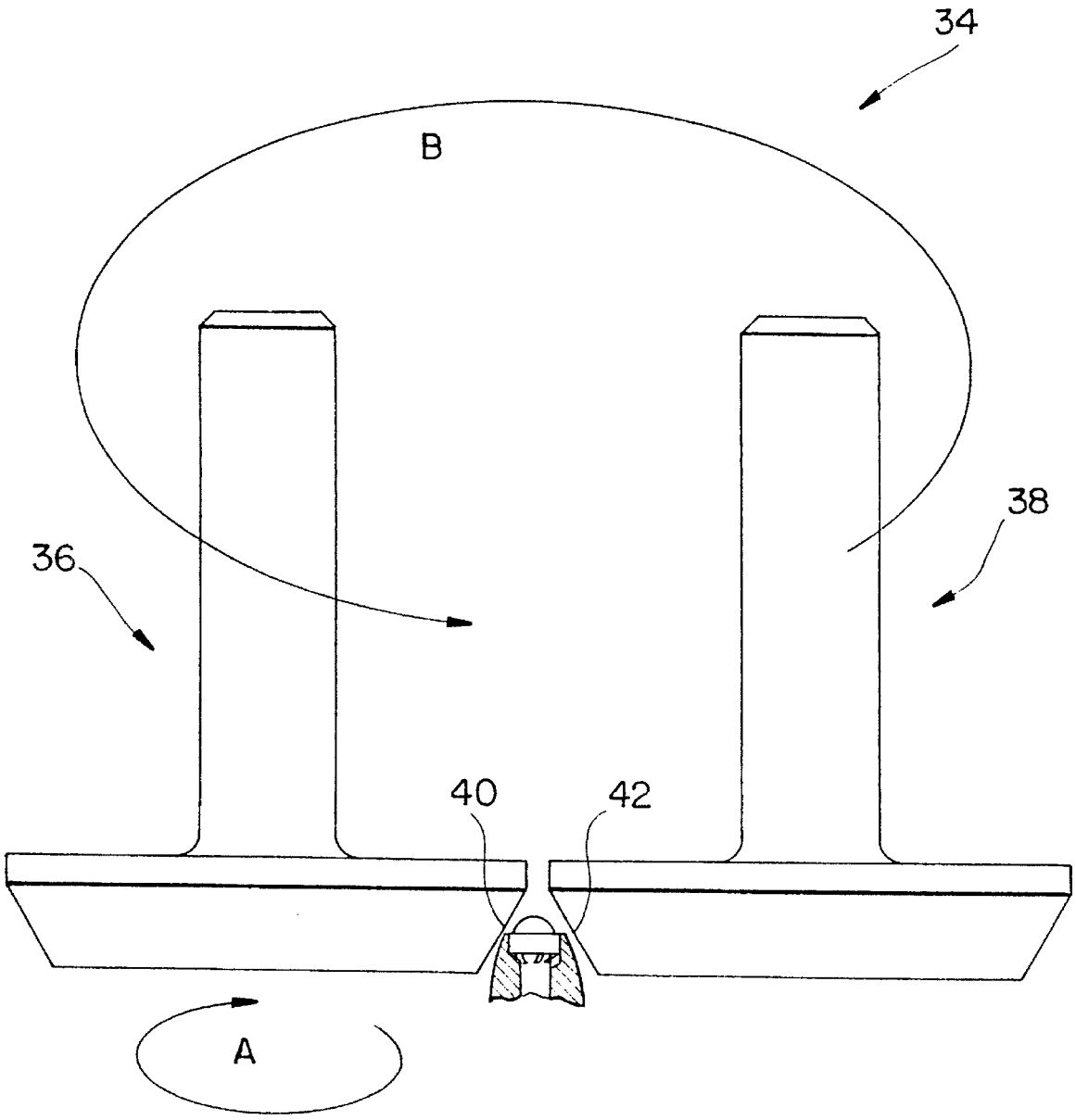
FIG. 7 shows a schematic view of a spinning machine being used to spin a pen tip according to one embodiment of the invention.

FIG. 7 shows a conventional spinning head 34, which includes rollers 36 and 38. A typical spinning head may be obtained from Mikron, Lugano, Switzerland. The entire spinning head 34 is driven in rotation in the direction indicated by the large arrow (B), while rollers 36 and 38 are freewheeling and rotate in the opposite direction upon contacting the pen tip, as indicated by the smaller arrows (A). Spinning head faces 40 and 42 are inclined to provide the desired spin angle, preferably about sixty degrees, as described above. The amount of elongation which the metal of rim 22 experiences, and thus the thinning of the rim which occurs, depends upon the speed of revolution of the spinning head 34 and force applied to the spinning head. By controlling the speed of the spinning head and the force applied, as is well known in the art, the thickness of finished rim structure 22' can be easily maintained more or less constant, regardless of the initial rim thickness used. Typical spinning pressures and spinning speeds are well known to those skilled in the art.

FIG. 8 shows an enlarged, detailed view of the finished pen tip. The inner diameter $F_1$ of the socket at the intersection of seat 20 and cylindrical wall 11 (intersection 19) has not been changed by the spinning operation, and remains significantly larger than the diameter of ball 24. Finished rim structure 22' has finished rim thickness $C_3$ of approximately 0.025 millimeter.

While particular embodiments have been described above, other variations and modifications are within the scope of the following claims.

I claim:

1. A method of obtaining the optimum ink flow of ball point pens comprising the steps of:

(a) providing a first tubular member with a hollow interior placeable in fluid communication with an ink supply, a socket formed at one end of said member having a seat structure and a cylindrical wall having a substantially uniform diameter extending from said seat structure to a rim structure disposed at the end of said cylindrical wall opposite said seat structure, wherein said rim structure has a first thickness, (b) inserting a ball of lesser maximum diameter than said cylindrical wall diameter into said socket, (c) reducing the circumferential dimensions of said rim structure to retain said ball in said socket, and (d) measuring a first ink laydown, thereafter (e) providing another tubular member with a hollow interior placeable in fluid communication with an ink supply, a socket formed at one end of said member having a seat structure and a cylindrical wall extending from said seat structure to a rim structure disposed at the end of said cylindrical wall opposite said seat structure, said tubular member having the same dimensions as said first tubular member, (f) facing the rim to remove a portion of the socket wall of said second tubular member to obtain a rim structure having a second thickness, (g) inserting a ball of equal dimension as that of said ball of said first tubular member into said socket of said second tubular member, (h) reducing the circumferential dimensions of said rim structure to retain said ball in said socket, and (i) measuring a second ink laydown, different from said first ink laydown, (j) repeating the process until the desired optimum ink flow is achieved.

2. The method of claim 1 wherein the diameter of said ball is at least about 0.03 millimeter smaller than the diameter of said seat structure at the intersection of said seat structure and the interior surface of said cylindrical wall.

3. The method of claim 2 wherein the diameter of said ball is about 0.05 to 0.08 millimeter smaller than the diameter of said seat structure at the intersection of said seat structure and the interior surface of said cylindrical wall.

4. The method of claim 1 wherein each said seat structure includes a central aperture, an array of delivery channels extending radially from said aperture for delivering ink to the surface of said ball, and lands disposed between said delivery channels contactable with the surface of said ball.

5. The method of claim 4 wherein said delivery channels extend to the interior surface of said cylindrical wall in said socket.

6. The method of claim 5 wherein the diameter of said ball is from about 0.05 to 0.08 millimeter smaller than the diameter of said seat structure at the intersection of said seat structure and said interior wall.

* * * * *